US008720224B2

(12) United States Patent
Brown

(10) Patent No.: US 8,720,224 B2
(45) Date of Patent: May 13, 2014

(54) GRAVITY FLOODED EVAPORATOR AND SYSTEM FOR USE THEREWITH

(75) Inventor: Justin Marc Brown, Fayetteville, GA (US)

(73) Assignee: REJ Enterprises, LLP, Peachtree City, GA (US)

( * ) Notice: Subject to any disclaimer, the term of this patent is extended or adjusted under 35 U.S.C. 154(b) by 634 days.

(21) Appl. No.: 12/704,869

(22) Filed: Feb. 12, 2010

(65) Prior Publication Data

US 2011/0197603 A1 Aug. 18, 2011

(51) Int. Cl.
*F25B 39/02* (2006.01)
*F25B 43/00* (2006.01)
*F25B 41/06* (2006.01)

(52) U.S. Cl.
USPC ..... 62/515; 62/512; 62/511; 62/503

(58) Field of Classification Search
USPC ..... 62/504, 515, 524–525, 299, 503, 511, 62/512; 165/111
See application file for complete search history.

(56) References Cited

U.S. PATENT DOCUMENTS

| | | | | |
|---|---|---|---|---|
| 1,954,695 | A | 4/1934 | Garland | |
| 2,005,277 | A | 6/1935 | Touborg et al. | |
| 2,009,975 | A | 7/1935 | Rosebrook | |
| 2,042,558 | A | 6/1936 | Steenstrup | |
| RE20,933 | E | 11/1938 | Altenkirch | |
| 2,154,562 | A | 4/1939 | Crosley et al. | |
| 2,189,731 | A | 2/1940 | Hanson | |
| 2,328,189 | A | 8/1943 | Brace et al. | |
| 3,171,263 | A | 3/1965 | Harnish | |
| 4,829,780 | A * | 5/1989 | Hughes et al. | 62/288 |
| 4,840,033 | A | 6/1989 | Garland | |
| 5,189,885 | A | 3/1993 | Ni | |
| 5,561,987 | A * | 10/1996 | Hartfield et al. | 62/471 |
| 5,765,393 | A * | 6/1998 | Shlak et al. | 62/507 |
| 5,771,703 | A | 6/1998 | Rajendran | |
| 5,832,743 | A | 11/1998 | Adamovsky | |
| 6,442,966 | B1 * | 9/2002 | Wiser | 62/511 |
| 6,684,658 | B2 | 2/2004 | Holtzapple et al. | |
| 7,073,572 | B2 | 7/2006 | Ayub | |
| 7,178,361 | B2 | 2/2007 | Thors et al. | |
| 2004/0010913 | A1 | 1/2004 | Thors et al. | |
| 2008/0041096 | A1 | 2/2008 | Sakashita et al. | |

FOREIGN PATENT DOCUMENTS

SE PCT/SE2008/051257 * 11/2008

* cited by examiner

*Primary Examiner* — Brandon M Rosati
*Assistant Examiner* — Elizabeth Martin
(74) *Attorney, Agent, or Firm* — Baker & Hostetler LLP

(57) ABSTRACT

Disclosed is a gravity flooded evaporator for use with commercial or industrial heating, air conditioning, and ventilation systems, and which does not require integration or use of a conventional, separately field-piped, surge vessel and associated subsystem.

18 Claims, 1 Drawing Sheet

GRAVITY FLOODED EVAPORATOR AND SYSTEM FOR USE THEREWITH

TECHNICAL FIELD

The present invention relates, generally, to gravity flooded evaporators for use with heating, air conditioning, and ventilation systems; and, more particularly, to gravity flooded evaporators for use with commercial or industrial heating, air conditioning, and ventilation systems, which evaporators do not require integration or use of a conventional, separately field-piped, surge vessel within such systems.

BACKGROUND OF THE INVENTION

The refrigeration cycle as utilized in typical heating, ventilation, and air conditioning ("HVAC") systems is well-known. Although the specific components comprising an HVAC system may vary depending upon system design architecture and performance specifications, at its essence, the HVAC system is made up of four critical components. In a refrigeration system, a liquefied refrigerant is metered by a thermal expansion or pressure reduction valve into a lower pressure environment of an evaporator. In the evaporator, the refrigerant changes phase from a liquid to a vapor as it absorbs heat from a liquid to be cooled. A compressor then draws the refrigerant vapor from the evaporator, raises its pressure, and discharges the refrigerant into a condenser. In the condenser, the heat absorbed in the evaporator is discarded to a heat sink, and the refrigerant changes phase from a vapor to a liquid. Thereafter the liquefied refrigerant may begin another cycle.

In such HVAC systems, especially in modern, large capacity commercial or industrial systems, it is relatively typical that a gravity-flooded evaporator is utilized. Such evaporators have the advantage of providing relatively large cooling capacities, and are used to cool large commercial or industrial structures such as office buildings, stores, malls, warehouses, factories, and the like.

In essence, an evaporator is a shell-and-tube type heat exchanger. That is to say, an evaporator of this type typically has a plurality of tubes contained within a shell. The arrangement of the tubes is optimized to provide multiple, often parallel flow paths for one of two fluids between which it is desired to exchange heat.

In a flooded evaporator, the tubes are immersed in a second fluid. Heat is transferred between the fluids through the walls of the tubes. For example, in some large capacity HVAC (air conditioning) applications, a fluid, such as chilled water, glycol, or brine, flows through the tubes, and a refrigerant is contained in the volume confined between the heat exchanger shell and the outside surfaces of the tubes. In the case of an evaporator for such an application, the refrigerant cools the fluid by heat transfer from the fluid to the walls of the tubes and, subsequently, to the refrigerant. Transferred heat vaporizes the refrigerant in contact with the exterior surfaces of the tubes.

In a gravity flooded evaporator of the type described, liquid refrigerant is introduced into a lower part of the evaporator shell, and the level of liquid refrigerant in the evaporator shell is maintained sufficiently high so as to assure that each individual tube is immersed below the level of liquid refrigerant in the majority of operating conditions. As the heat is transferred from the fluid flowing inside the tubes to the refrigerant, the refrigerant is caused to boil, with the vapor passing to the surface, where it is subsequently withdrawn from the evaporator by suction of the compressor.

In the more typical commercial or industrial HVAC system under consideration herein; however, a refrigerant fills the evaporator tubes, and air is directed over and across the tubes by large fans. In this regard, forced air essentially "immerses" the tubes and allows the above-described heat transfer to occur.

In order to maintain an adequate feed supply of liquid refrigerant to the evaporator tubes, and in order to provide a receptacle for collection of withdrawn, vaporized refrigerant, such systems often require the introduction and integration of a conventional, separately field-piped, surge vessel. Sometimes also known as a surge drum, a dual-state pressure vessel, an accumulator, or the like, a surge vessel, which is plumbed into the low pressure side of an HVAC system, and at an elevation greater than the evaporator, essentially provides the dual function of a separation chamber and an overflow container into which liquid refrigerant may be collected for recirculation to the evaporator; and, into which refrigerant that is in gaseous state may be collected simultaneously for return to the compressor.

Consistent with this functionality, a surge vessel may also act to absorb surges in refrigerant from the evaporator, such as may occur as a result of operational load variance. For example, lighter loads produce less vapor; thereby, allowing a greater liquid component within the tubes. On the other hand, heavier loads produce more vapor; thereby, reducing the liquid component within the tubes. Thus, a surge vessel provides a receptacle into which excess liquids or vapors may be driven according to the operational load characteristics of the evaporator.

Finally, a surge vessel may act to capture the sometimes violent liquid surges that may occur when the suction line of a flooded evaporator is opened. When the line is opened, a pressure drop occurs. This pressure drop flashes a quantity of liquid refrigerant into vapor, and this vapor can nearly instantly force the entire remaining charge of liquid into the surge vessel.

Thus, a surge vessel operates to buffer liquid and vapor refrigerant surges within the HVAC system; to collect dual-state (to wit; liquid and vapor) refrigerant from the evaporator; to separate that refrigerant according to its state; and to, thereafter, allow the refrigerant, if in liquid state, to be recirculated by gravity directly into the evaporator, or, if in gaseous state, to be recompressed and condensed into liquid state for subsequent return to the evaporator.

As will become readily apparent, a system configured in accordance with the description above, or which is similar thereto by virtue of the presence of a gravity flooded evaporator and a conventional, separately field-piped, surge vessel, is disadvantageous for a variety of reasons. For example, in prior art systems using surge vessel technology, there is a significant user-borne cost due to the requirement for a separately field-piped, expensive, pressure rated and pressure tested, certified, surge vessel and associated subsystem. There is a potential for decreased system quality and reliability, due to field-piping and installation errors in connecting the surge vessel into the system. In that regard, it takes time and resources to design, procure, install, and inspect such a field-piped subsystem, taking into consideration requirements for compliance with boiler and pressure vessel codes, additional valving and piping requirements, initial and life-cycle pressure testing, ongoing maintenance, cyclical component replacement, and the like, all of which are associated with installation and operation of an HVAC system with a surge vessel.

Furthermore, there are greater installation and maintenance costs due to increased required volumes of liquid refrigerant to charge the evaporator and surge vessel, with associated regulatory concerns and associated procurement and disposal costs. Overall system footprint and cost is increased due to the additional space requirements for the surge vessel and associated piping.

Still further, in a system with a surge vessel, there is a differential in the static height of the liquid refrigerant under varying operational load states, which may tend to reduce evaporator capacity due to added net saturation pressure and/or temperature. There are energy losses by virtue of the compressor needing to compress a larger volume of vapor, which results in greater work and higher operational costs due to increased energy consumption.

Thus, considering the above-described disadvantages inherent within an industrial HVAC system comprising a gravity flooded evaporator and a conventional, separately field-piped, surge vessel, it would be preferable to provide, and to be able to recognize the benefits of, a system not requiring use of a separately field-piped surge vessel. It is to the provision of such an HVAC system that the present disclosure is now directed.

BRIEF SUMMARY OF THE INVENTION

Briefly described, in a preferred embodiment, the apparatus, and process of the present disclosure overcome the above-mentioned disadvantages, and meet the recognized needs, by providing an internally gravity flooded evaporator that does not require a separately field-piped surge vessel and associated subsystem.

According to its major aspects, and broadly stated, an exemplary apparatus, and a process according to the present disclosure, provides for a level of liquid refrigerant to be maintained in a first vertical tube interconnected with a tee joint located at an elevation above the refrigerant tubes of an evaporator. In an exemplary embodiment, the first vertical tube is disposed adjacent a first side of the evaporator unit. Liquid refrigerant flows into the evaporator tubes via gravity; and, in accordance with the heat transfer characteristics of the evaporator as described hereinabove, the liquid/vapor mixture flows out of the refrigerant tubes adjacent a second side of the evaporator unit; and then flows into a second vertical tube disposed adjacent a second side of the evaporator unit. System pressure forces the liquid/vapor mixture upward through the second vertical tube, and into an upper, horizontally disposed tube section located at an elevation above the refrigerant tubes of the evaporator. The upper, horizontally disposed tube section may be of similar diameter to the above-described, first vertical tube so that it may be returned into the common tee joint, or may be coupled thereto through use of an appropriate adapter.

The liquid/vapor mixture travels horizontally along the upper, horizontally disposed tube section, wherein the refrigerant in the liquid state falls due to gravity, and wherein refrigerant in the vapor state remains near the top. Upon entering the tee joint, refrigerant in the vapor state is exhausted upwardly for return to the system compressor via a system suction line, whereas refrigerant in the liquid state falls downwardly to the liquid refrigerant level interface, whereafter it may be resupplied by gravity into the evaporator tubes.

Accordingly, the disclosure made herein improves upon prior art systems, and reduces the disadvantages of such prior art systems, by providing an evaporator that houses a liquid/vapor reservoir and return system within the evaporator housing, as an integrally manufactured component part of the evaporator unit; thereby, removing the need for a conventional, separately field-piped, surge vessel and subsystem associated with such prior art HVAC systems.

These and other aspects of the apparatus and process of the present disclosure will become apparent to those of ordinary skilled in the art after reading the following Detailed Description of Illustrative Embodiments and Claims in light of the accompanying drawing Figures.

BRIEF DESCRIPTION OF THE DRAWINGS

The following specification is best read in conjunction with the accompanying drawing Figures, in which like reference numbers throughout the various drawing Figures designate like structure, and in which.

Figure 1:
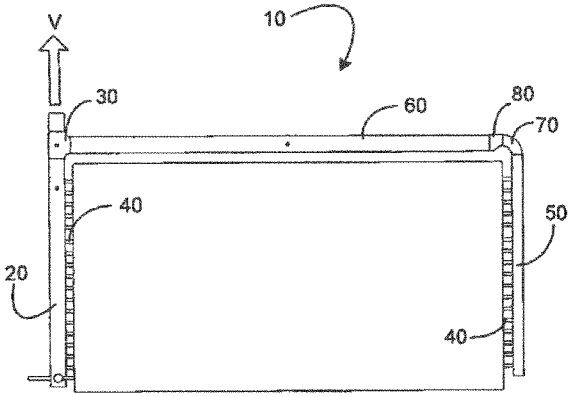
FIG. 1 is a front elevation view of an evaporator in accordance with the present disclosure.

It is to be noted that the drawing Figures presented are intended solely for the purpose of illustration and that they are, therefore, neither desired nor intended to limit the disclosed subject matter to any or all of the exact details of construction shown, or to any specific embodiment thereof, except insofar as they may be deemed essential to the Claims hereof.

DETAILED DESCRIPTION OF ILLUSTRATIVE EMBODIMENTS

In describing preferred embodiments of the subject matter of the present subject matter, as illustrated in the drawing Figures, specific terminology is employed for the sake of clarity. The claimed subject matter, however, is not intended to be limited to the specific terminology so selected, and it is to be understood that each specific element includes all technical equivalents that operate in a similar manner to accomplish a similar purpose.

Figure 2:
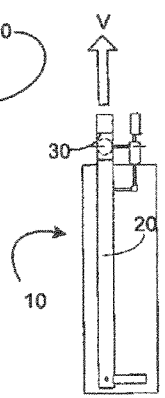
FIG. 2 is a side elevation view of the evaporator of FIG. 1 in accordance with the present disclosure.
Figure 3:
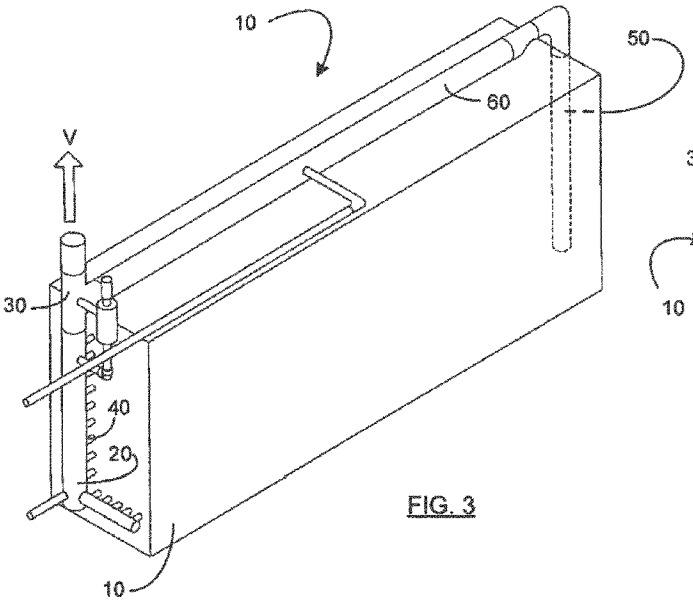
FIG. 3 is a perspective view of the evaporator of FIGS. 1-2 in accordance with the present disclosure.
Figure 4:
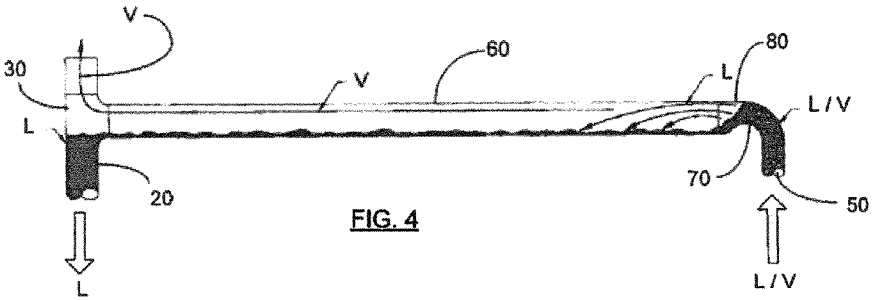
FIG. 4 is a front elevation cut-away view of a liquid and vapor refrigerant separation tube in accordance with the present disclosure.

Referring now more particularly to the drawing Figures, and to that embodiment of the subject matter hereof presented by way of illustration, FIGS. 1-3 depict evaporator 10 made in accordance with the subject matter of the present disclosure. FIG. 4 depicts certain flow and transport processes for, and attributes of, liquid and vapor refrigerant within evaporator 10.

As shown in FIGS. 1-4, evaporator 10 is an internally gravity flooded evaporator for use with large capacity commercial or industrial heating, ventilation, and air conditioning ("HVAC") systems. Believed to be unique characteristics of construction, internal refrigerant process and flow, and use, evaporator 10 does not require a separately field-piped surge vessel and associated subsystem. The significant advantages of this construction will be detailed further below.

In accordance with a process for circulating a refrigerant within evaporator 10, and in accordance with a construction of evaporator 10 in order to support said process, which process obviates the need for use of a prior art surge vessel and supporting subsystem, evaporator 10 provides for a level of liquid refrigerant L to be maintained in a first vertical tube 20. Vertical tube 20 is interconnected with tee joint 30 located at an elevation above refrigerant tubes 40 of evaporator 10. In an exemplary embodiment, first vertical tube 20 typically is disposed adjacent a first side of evaporator 10, which is depicted in the FIGS. as being the left side. It will be appreciated by those of ordinary skill in the art, however, that any designations set forth herein as to left or right sides of evaporator 10 may be reversed without affecting the functionality set forth and described herein.

Liquid refrigerant L flows into evaporator refrigerant tubes 40 via gravity; and, in accordance with the heat transfer characteristics of evaporator 10 as described, generally, hereinabove, liquid/vapor refrigerant mixture L/V flows out of refrigerant tubes 40 typically adjacent a second side (herein depicted as the right side) of evaporator 10; and then flows into second vertical tube 50 typically disposed adjacent a second side of evaporator 10. Best seen with reference to FIG. 4, system pressure forces liquid/vapor refrigerant mixture L/V upwardly through second vertical tube 50, and into upper, horizontally disposed tube section 60 located at an elevation above refrigerant tubes 40 of evaporator 10. Upper, horizontally disposed tube section 60 is of similar diameter to above-described, first vertical tube 20, so that it may be returned into common tee joint 30; thereby, creating a return loop subsystem. Alternatively, horizontally disposed tube section 60 may be coupled into common tee joint 30 through use of an appropriate adapter, as is known in the art.

Best observed in FIG. 4, second vertical tube 50 transitions into upper, horizontally disposed tube section 60 through bend 70 and expansion joint 80. Expansion joint 80, in addition to providing a mechanical transition between tube diameters, further acts to reduce the velocity of liquid/vapor refrigerant mixture L/V flowing from second vertical tube 50 into upper, horizontally disposed tube section 60. Advantageously, such velocity drop enables separation of liquid/vapor refrigerant mixture L/V in a region proximate expansion joint 80, and along the length of upper, horizontally disposed tube section 60, all as will be set forth in greater detail below.

Accordingly, and with continuing reference to FIG. 4, liquid/vapor refrigerant mixture L/V travels horizontally along upper, horizontally disposed tube section 60, wherein refrigerant L in a liquid state falls due to gravity, and wherein refrigerant V in a vapor state remains near the top (to wit; at a higher elevation with respect to refrigerant L in a liquid state) of upper, horizontally disposed tube section 60. Upon entering tee joint 30, refrigerant V in a vapor state is exhausted upwardly for return to a system compressor via a system suction line, whereas refrigerant L in a liquid state falls downwardly to the liquid refrigerant L level interface, whereafter it may be resupplied by gravity into evaporator tubes 40.

It will now be apparent that the disclosure made herein improves upon prior art systems, and reduces the disadvantages of such prior art systems, by providing an evaporator that houses a liquid/vapor reservoir and return system within the physical confines of an evaporator housing, as an integrally manufactured component part of the evaporator unit; thereby, removing the need for a conventional, separately field-piped, surge vessel and subsystem associated with such prior art HVAC systems.

Evaporator 10, constructed as set forth hereinabove, or as an equivalent thereto, is believed to provide at least the following several benefits over prior art systems comprising a conventional, separately field-piped, surge vessel and subsystem:

There is a significant reduction in user-borne cost due to avoidance of any requirement for a separately field-piped, expensive, pressure rated and pressure tested, certified, surge vessel and associated subsystem. There is a potential for significantly increased system quality and reliability, due to avoidance of field-piping and installation errors in connecting a prior art surge vessel into the system. In that regard, the time and resources required to design, procure, install, and inspect such a field-piped subsystem, taking into consideration requirements for compliance with boiler and pressure vessel codes, additional valving and piping requirements, initial and life-cycle pressure testing, ongoing maintenance, cyclical component replacement, and the like, all of which are associated with installation and operation of an HVAC system with a surge vessel, may now be obviated.

Furthermore, there are fewer, and/or substantially reduced, installation and maintenance-related costs due to decreased required volumes of liquid refrigerant to charge only the evaporator, and not a supplementary, large capacity surge vessel, now with decreased regulatory concerns and with reduced procurement and disposal costs. Overall system footprint and cost may now be reduced due to the reduced space requirements for a system without a surge vessel and associated piping.

Still further, in a system without a surge vessel, there is a reduced differential in static height of the liquid refrigerant under varying operational load states, which may tend to increase evaporator capacity due to reduced net saturation pressure and/or temperature. There are fewer energy losses by virtue of the compressor needing to compress a lesser volume of vapor, which results in reduced work and lower operational costs due to reduced energy consumption.

Having now described a preferred embodiment of the disclosed subject matter, it will be apparent to those of ordinary skill in the art that certain departures from the disclosure may be made without significantly detracting from the benefits described with regard to the preferred embodiment. For example, it will be apparent that tube diameters may be changed, varied, matched, and/or specified in order best to suit the HVAC application, size specifications, and performance requirements at-hand. In furtherance of such particulars, it will be further apparent that joint and tee sizes and configurations may be adjusted in order to conform to the relevant tube diameters being utilized. It will be apparent that direction of refrigerant flow may be reversed from right-to-left, and vice versa, with associated conformity of location as to the components hereinabove described. Similarly, evaporator size, tube elevations and separations may be adjusted, again, to suit the HVAC application, size specifications, and performance requirements at-hand.

In that regard, it will be apparent to those of ordinary skill in the art that first vertical tube 20 and second vertical tube 50 may be disposed adjacent a single side of evaporator 10, whether left, right, or otherwise, with appropriate reconfiguration of the refrigerant flow circuit, namely refrigerant tubes 40, to accommodate such physical arrangement and placement. It will be further apparent that refrigerant tubes 40 may be a single tube or a plurality of such tubes, and that such tube or tubes may comprise a horizontally or vertically disposed refrigerant flow circuit.

It will also be apparent to those of ordinary skill in the art that first vertical tube 20 and second vertical tube 50 may be disposed in a horizontal configuration without departing from the essential functionality of the subject matter disclosure hereof; for example, wherein a horizontal tube corresponding to first vertical tube 20 may be proximate a lower elevation of evaporator 10, and wherein a horizontal tube corresponding to second vertical tube 50 may be proximate a higher elevation of evaporator 10, or otherwise as the refrigerant flow circuit may dictate.

It will, therefore, be understood that the particular embodiment of the subject matter here presented is by way of illustration only, and is, in no way, meant to be restrictive; therefore, numerous changes and modifications may be made, and the full use of equivalents resorted to, without departing from the spirit or scope of the subject matter as provided in the appended Claims.

What is claimed:

1. An internally gravity flooded evaporator for use with a commercial or industrial heating, ventilation, and air conditioning ("HVAC") system, the evaporator comprising:

a. a first vertical tube disposed adjacent a side of the evaporator;

b. a second vertical tube disposed adjacent a side of the evaporator;

c. a refrigerant tube disposed within a housing of the evaporator and interconnected with the first vertical tube and with the second vertical tube;

d. the second vertical tube interconnected with a tubular expansion joint disposed at an elevation above the refrigerant tube;

e. a horizontal tube disposed at an elevation higher than the refrigerant tube;

f. the horizontally disposed tube being interconnected with the tubular expansion joint on one end and with the first vertical tube on the other end;

g. said first and second vertical tubes, refrigerant tube, tubular expansion joint, and horizontally disposed tube forming, in association with the evaporator, a return loop refrigerant subsystem, the evaporator not requiring use of a separately field-piped surge vessel within the HVAC system to which the evaporator is attached.

2. The evaporator of claim 1, wherein said refrigerant tube comprises a plurality of refrigerant tubes.

3. The evaporator of claim 2, wherein each said refrigerant tube is interconnected at a first end with the first vertical tube, and is interconnected at a second end with the second vertical tube.

4. The evaporator of claim 1, wherein the first vertical tube is of larger diameter than the second vertical tube.

5. The evaporator of claim 1, wherein the horizontally disposed tube is of substantially equivalent diameter to the first vertical tube.

6. The evaporator of claim 1, wherein a bend and the tubular expansion joint are positioned between the second vertical tube and the horizontally disposed tube.

7. The evaporator of claim 1, wherein the expansion joint acts to reduce velocity of a refrigerant flowing from the second vertical tube into the horizontally disposed tube.

8. The evaporator of claim 1, wherein the first vertical tube is charged with a liquid refrigerant.

9. The evaporator of claim 8, wherein the liquid refrigerant passes from the first vertical tube into the refrigerant tube by operation of gravity.

10. The evaporator of claim 9, wherein, upon transfer of heat from a fluid or gas outside of the refrigerant tube, the liquid refrigerant within the refrigerant tube is rendered into a refrigerant mixture comprising a liquid state and a vapor state.

11. The evaporator of claim 10, wherein the refrigerant mixture comprising a liquid state and a vapor state passes from the refrigerant tube into the second vertical tube.

12. The evaporator of claim 11, wherein the refrigerant mixture passes from the second vertical tube into the horizontal tube.

13. The evaporator of claim 12, wherein the refrigerant mixture is separated by reduced velocity and gravity, proximate to and within the horizontal tube, into a refrigerant in liquid state and a refrigerant in vapor state.

14. The evaporator of claim 13, wherein the refrigerant in liquid state is returned to the first vertical tube, and the refrigerant in vapor state is exhausted to a system compressor via a system suction line.

15. A heating, ventilation, and air conditioning ("HVAC") system comprising:

a. a compressor;

b. a condenser;

c. a thermal expansion or pressure reduction valve; and d. an evaporator, said evaporator comprising a first vertical tube disposed adjacent a side of the evaporator, a second vertical tube disposed adjacent a side of the evaporator, a refrigerant tube disposed within a housing of the evaporator and interconnected with the first vertical tube and with the second vertical tube, said second vertical tube interconnected with a tubular expansion joint disposed at an elevation above the refrigerant tube, a horizontally disposed tube disposed at an elevation higher than the refrigerant tube, said horizontally disposed tube interconnected with said tubular expansion joint; a return loop refrigerant subsystem being formed by said first and second vertical tubes, refrigerant tube, tubular expansion joint, and horizontally disposed tube, in association with the evaporator, the evaporator not requiring use of a separately field-piped surge vessel within the HVAC system to which the evaporator is attached.

16. The evaporator of claim 15, wherein a bend and the tubular expansion joint are positioned between the second vertical tube and the horizontally disposed tube.

17. A process for separation of a liquid/vapor refrigerant mixture in association with a heating, ventilation, and air conditioning ("HVAC") system evaporator, the process comprising the steps of:

a. establishing a level of liquid refrigerant, and containing that refrigerant in a first tube;

b. passing the liquid refrigerant into an evaporator refrigerant tube via gravity;

c. transferring heat to the liquid refrigerant within the evaporator refrigerant tube, whereupon the liquid refrigerant is rendered into a refrigerant mixture comprising a liquid state and a vapor state;

d. passing the liquid/vapor refrigerant mixture from the refrigerant tube into a second tube;

e. forcing the liquid/vapor refrigerant mixture through the second tube and into a horizontally disposed tube located at an elevation above the refrigerant tube;

f. separating, proximate to and within the horizontally disposed tube, the liquid/vapor refrigerant mixture into a refrigerant in liquid state and a refrigerant in vapor state by operation of a tubular expansion joint located between the second tube and the horizontally disposed tube;

g. providing for refrigerant in a liquid state to fall due to gravity and return into the first tube, whereafter it is resupplied by gravity into the evaporator refrigerant tube; and h. passing refrigerant in a vapor state to an exhaust for return to a system compressor via a system suction line;

i. all in the absence of a separately field-piped surge vessel within the HVAC system to which the evaporator is attached.

18. The process of claim 17, further comprising the step of:

f. reducing velocity of a liquid/vapor refrigerant mixture within the horizontally disposed tube by operation of the expansion joint between the second tube and the horizontally disposed tube.

* * * * *